US005378863A

United States Patent [19]

Sekita

[11] Patent Number: 5,378,863

[45] Date of Patent: Jan. 3, 1995

[54] ELECTRIC SWITCH

[75] Inventor: Youichi Sekita, Turugashima, Japan

[73] Assignee: Toyodenso Kabushiki Kaisha, Tokyo, Japan

[21] Appl. No.: 12,747

[22] Filed: Feb. 3, 1993

[30] Foreign Application Priority Data

Feb. 6, 1992 [JP] Japan ..... 4-013086[U]

[51] Int. Cl.[6] ..... H01H 15/00; H01H 21/84

[52] U.S. Cl. ..... 200/16 R; 200/16 D; 200/337

[58] Field of Search ..... 200/16 C, 16 D, 16 R, 200/17 R, 18

[56] References Cited

U.S. PATENT DOCUMENTS

| | | | |
|---|---|---|---|
| 2,683,193 | 7/1954 | Barcus | 200/16 C |
| 2,710,317 | 6/1955 | Pearl | 200/16 C |
| 2,977,432 | 3/1961 | Spicer, Jr. | 200/16 C |
| 3,106,619 | 10/1963 | Scheid | 200/16 D |
| 3,209,088 | 9/1965 | Wanlass et al. | 200/16 C |
| 3,500,003 | 3/1970 | Schink | 200/16 C |
| 3,614,346 | 10/1971 | Gudaitis et al. | 200/16 R |
| 3,922,510 | 11/1975 | Arthur | 200/16 D X |

FOREIGN PATENT DOCUMENTS

| | | | |
|---|---|---|---|
| 58-79831 | 5/1983 | Japan | H01H 21/84 |
| 60-42430 | 12/1985 | Japan | H01H 23/30 |
| 61-16579 | 5/1986 | Japan | H01H 23/00 |
| 63-28819 | 8/1988 | Japan | H01H 21/00 |
| 63-33454 | 9/1988 | Japan | H01H 15/16 |
| 63-50754 | 12/1988 | Japan | H01H 21/84 |

*Primary Examiner*—J. R. Scott

[57] ABSTRACT

An electric switch for multiple circuits includes a slider with a movable contact. The slider is linearly slidable in forward and backward directions along the longitudinal axis of a switch casing. A holder carrying a fixed contact thereon is arranged within the casing so as to guide the forward and backward movement of the slider. A swingable manipulator is pivotally mounted on an end of the casing and linked with the slider to operate the same upon pivotal movement thereof in clockwise and counterclockwise directions. The slider is baised by a single coiled spring to its initial neutral position. With this arrangement, the switch accomplishes compact construction, reliable operation and easy assembling.

9 Claims, 5 Drawing Sheets

ELECTRIC SWITCH

BACKGROUND OF THE INVENTION

1. Field of the Invention

The present invention relates to an electric switch, and more particularly to an electric switch assembly provided with a function of a slider switch of push-pull type in which a switching operation to each of multiple circuits is performed by the linearly controlled forward and backward movement of a movable contact arranged on a slider and with a function of a see-saw switch in which the slider is operated by swingable movement of a manipulator.

2. Description of the Prior Art

There is known an electric switch assembly provided with a slider switch in which a movable contact is arranged on a slider. In such slider switch the switching operation may be assuredly performed by extending a stroke of movement of a movable contact, but the extension of the stroke of movement makes the the switch assembly greater in whole length. To avoid this disadvantage, there is proposed in a Japanese utility model publication No. S63-28819 such type of slider switch, as an example, that a swingable manipulator is linked with a slider so as to pull the latter out when it is operated against a force of a return spring, and that the opening and closing operation of a contact is effected through a turnover spring interlocked with the slider. In this slider switch, however, the manipulator is pushed merely in a one-way direction and the slider is capable of being moved merely between a neutral inoperative position and the pulled operative position. Thus the slider switch may serve as a pull switch but, without provision of push-pull function, may not perform switching operations for multiple circuits. The opening and closing operation of the contact is made by a circular arc motion of a movable plate interlocked with the turnover spring resulting in thicker switch. Hence it is required to make the whole of the switch thinner and more compact. Further, as spring means there are utilized the return spring for the manipulator and the turnover spring for the opening and closing of the contact thereby resulting in much component parts and complicated of assembling.

SUMMARY OF THE INVENTION

Therefore, the present invention is made in view of the afore-mentioned disadvantage of the known slider switch and an object of the present invention is to provide an improved electric switch which is compact and effectively capable of performing switching operations for each of multiple circuits.

To this end, according to the present invention, there is provided an electric switch comprising a substantially hollow casing, a slider being arranged within the hollow casing to be linearly movable in forward and backward directions along the longitudinal axis of the casing, means for returning the slider to the neutral inoperative position thereof, a movable contact being arranged on the slider, multiple electric circuits each of whose contacts is adapted to be selectively connected to the movable contact upon each forward and backward movement of the slider, and a manipulator being pivotally mounted on the casing to be swingable in clockwise and counterclockwise directions and operatively connected with an end of the slider to control the forward and backward movement of the latter, the returning means being provided on the slider with a spring for biassing the same to its neutral position.

In another form of the present invention, an electric switch comprises a substantially rectangular hollow casing, a slider being linearly movable from its neutral position in opposite forward and backward directions along the longitudinal axis of the casing, a holder being immovably arranged in the casing and slidably accommodating therein the slider to guide the forward and backward movement thereof, means for returning the slider to the neutral position thereof, a movable contact being arranged on the slider, multiple electric circuits each of whose contacts is fixedly arranged on a base plate which is provided on the holder to selectively come into contact with the movable contact upon each forward and backward movement of the slider, and a manipulator being pivoted on an end of the casing to be swingable clockwise and counterclockwise and operatively linked with an end of the slider to push and pull the latter in accordance with the clockwise and counterclockwise motion thereof, the returning means being provided in the slider with a compressed spring for biassing the same to its neutral position. With such an arrangement, when the manipulator swings around the pivot thereof to a predetermined direction, the slider linked with the manipulator is linearly moved either forwards or backwards so as to perform the switching operation of the multiple circuits. When the manipulator is released, the slider is moved to the neutral position by the returning means.

The above and other related objects and features of the present invention will be apparent from the following description of the disclosure when the same is read in connection with the accompanying drawings which are given by way of illustration only, and thus are not limitative of the present invention.

DETAILED DESCRIPTION OF THE PREFERRED EMBODIMENT

Figure 1:
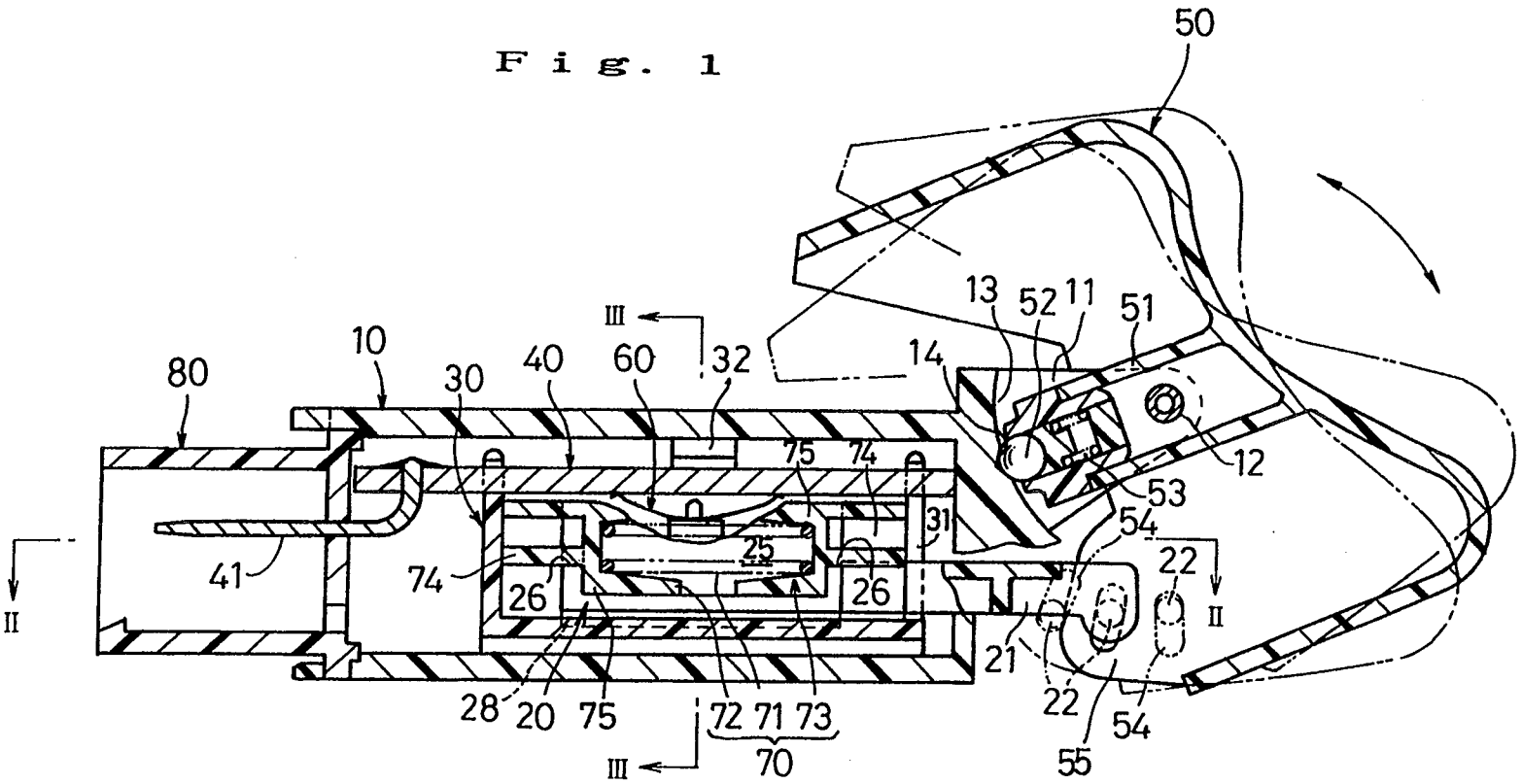
FIG. 1 is a longitudinally cross sectional view of an embodiment pursuant to the present invention.
Figure 3:
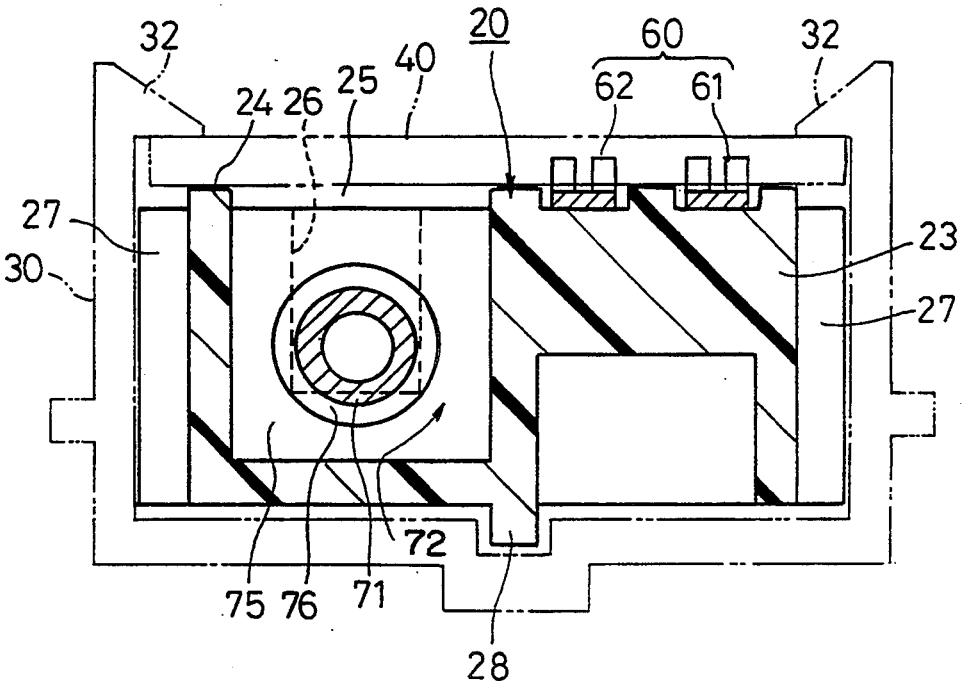
FIG. 3 is a transversely cross sectional view taken along line III—III of FIG. 1.
Figure 4:
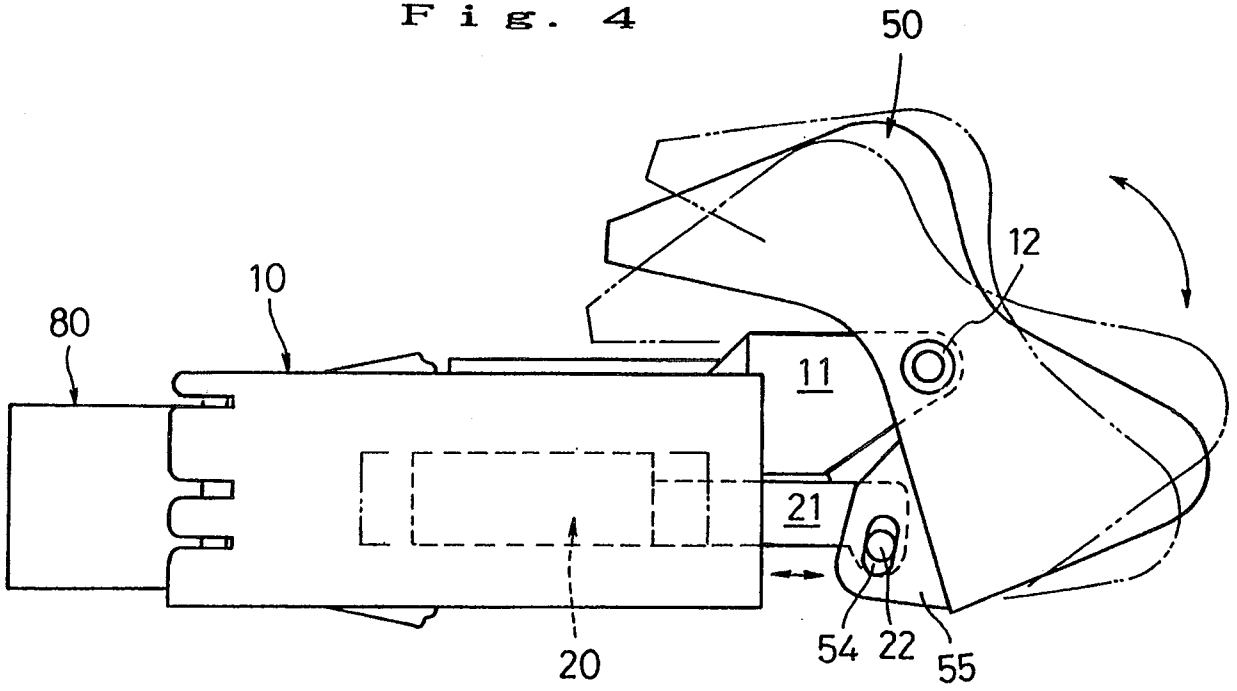
FIG. 4 is a side elevation of the embodiment.
Figure 5:
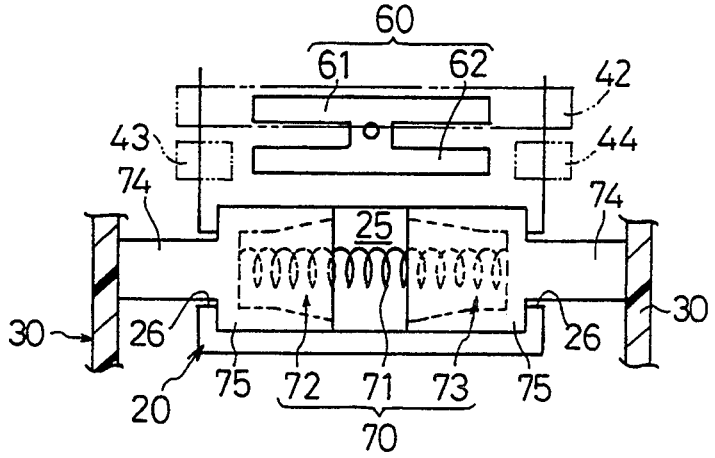
FIG. 5, 6 and 7 are schematic illustrations of an essential part of the present invention showing the operation thereof.
Figure 6:
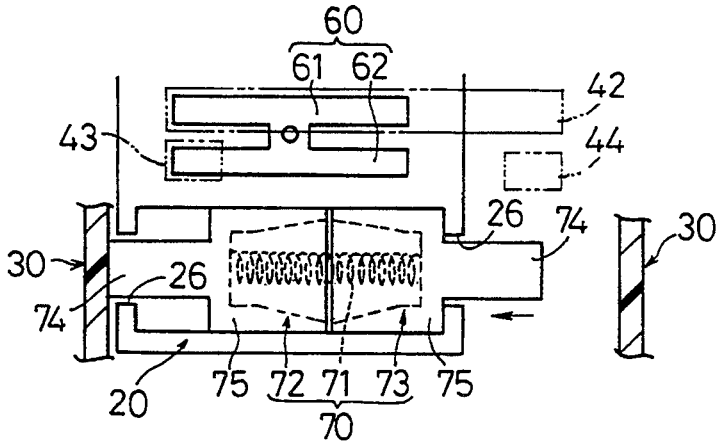
Figure 7:
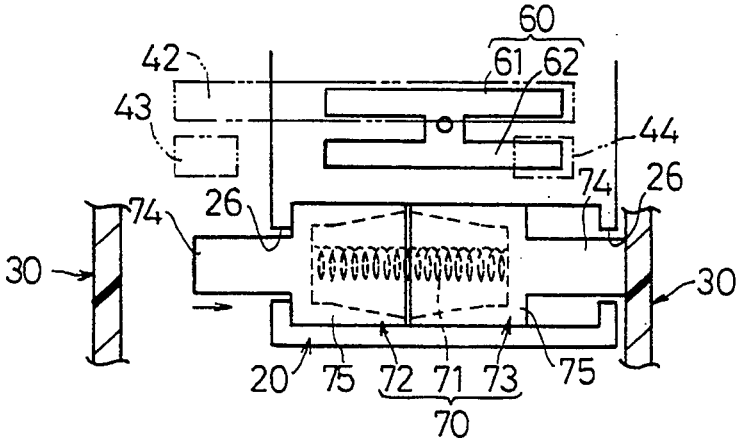

Referring now to the drawings, FIGS. 1 and 3 show longitudinally and transversely sectional partially cutaway illustrations of an electric switch, respectively, for opening and closing a movable roof of an automobile, while FIGS. 5 through 7 show schematic illustrations for explaining a relationship between a movable contact 60 and a neutral returning means 70. In these Figures, the electric switch generally comprises a hollow casing 10, a slider 20, a holder 30, a base plate 40 and a manipulator 50. On the slider 20 there are arranged the movable contact 60 of an elastic material such as a plate spring or the like formed substantially in the shape of a letter "H" and the neutral returning means 70 for returning the slider 20 to the neutral inoperative position thereof. The hollow casing 10 is formed of generally rectangular tubular shape and provided at opposite sides of an open end thereof with a pair of longitudinally projected support arms 11 on which the manipulator 50 is swingably mounted through a pivot shaft 12. The manipulator 50 has a clock holder 51 which extends inwardly from the mounted portion by the pivot shaft 12. A clock ball 52 is held in a distal end of the click holder 51 in a partially projected state therefrom and biassed by a spring 53. On the end of the casing 10 between the pair of the support arms 11 is formed a slant guide surface along which the click ball 52 is guided in slidable contact to thereby regulate the swingable movement of the manipulator 50. As shown in FIG. 1, in the neutral state of the manipulator 50 the spring-biassed click ball 52 is adapted to come into engagement with a concave portion 14 formed on the guide surface 13.

On the other end of the casing 10 there is mounted a coupler case 80, and into the inner space of the latter extends each distal end of terminals 41 which are connected at the basal ends thereof with the base plate 40.

Figure 2:
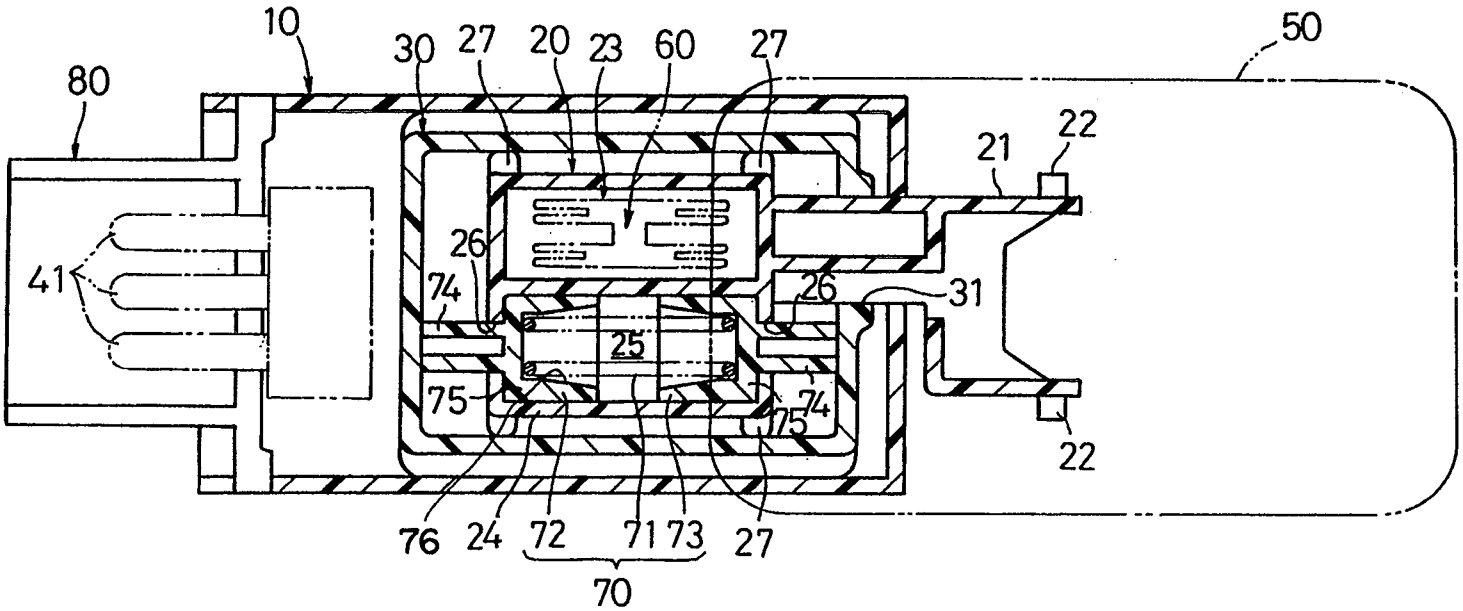
FIG. 2 is a cross sectional view taken along line II—II of FIG. 1.

The slider 20 is projected at an end 21 thereof outwards from the open end of the casing 10 and operatively linked with the manipulator 50 in such a state that a pair of engaging bosses 22, 22 formed on the opposed lateral sides of the projected end 21 are engaged with a pair of slots 54, 54 formed on extension walls 55, 55 of the manipulator 50. Hence, the slider 20 moves linearly in opposite forward and backward directions in such a manner as to be pushed into the casing 10 when the manipulator 50 swings clockwise around the pivot axis 12 and to be pulled out of the casing 10 upon a counterclockwise motion of the manipulator 50. As apparent from FIGS. 2 and 3, the slider 20 is slidably arranged in the holder 30 and formed on the right and left sides thereof along its longitudinal axis in the direction of movement with first and second rectangular compartments 23, 24 for having arranged the movable contact 60 and the neutral returning means 70 in a juxtaposed fashion. The second compartment 24 is provided with a recess 25 for accommodating the neutral returning means 70 and, on both the transverse walls thereof, with cutout openings 26, 26 for having slidably arranged a pair of pressure pieces, 72, 73 of the neutral returning means 70. Four ribs 27 are formed on each corner of the upper side of the first compartment 23 and on each corner of the lower side of the second compartment 24 in upwardly or downwardly projected fashion so as to slidably contact the internal wall of the holder 30. As shown in FIG. 3, a downwardly projected rail 28 is formed on a central portion of the bottom of the slider 20 and engaged with a groove formed on the holder 30. The holder 30 is formed generally in a shape of upwardly opened rectangular box so as to be fixedly arranged within the casing 10 and to be long enough to allow the forward and backward movement of the slider 20. On a transverse wall of the holder 30 there is provided a cutout 31 for passing therethrough the projected end 21 of the slider 20, and a pair of upwardly and horizontally projected hooks 32, 32 are formed on the right and left sides of the holder 30 thereby allowing the base plate 40 to be immovably carried on the holder 30 in engagement with each other.

As clearly shown in FIGS. 5 to 7, the movable contact 60 is formed with a pair of parallel extending first and second sliding pieces 61, 62 while the base plate 40 is formed with a common fixed contact 42 which extends from a forward end to a backward end of the stroke of movement of the movable contact 60 and with a pair of forward and backward fixed contacts 43, 44 each being located in the vicinity of and in parallel with the forward and backward ends of the common fixed contact 42. The first sliding piece 61 is arranged to slide in contact with the common fixed contact 42, and the second sliding piece 62 is arranged to selectively come into contact with each of the forward and the backward fixed contacts 43, 44 in accordance with the forward or backward movement of the movable contact 60. With this arrangement, when the first sliding piece 61 comes into contact with the forward fixed contact 43, a roof opening and closing circuit is closed, while the contact of the second sliding piece 62 with the backward fixed contact 44 brings a roof driving circuit to a closed state, for instance. When being in a neutral position, the movable contact 60 does not come into contact with either of the forward and the backward fixed contacts 43, 44. If there are provided three or more fixed contacts, the movable contact 60 will be available for three or more circuits.

The neutral returning means 70 comprises a coiled spring 71 and the pair of the pressure pieces 72, 73 provided on both ends of the coiled spring 71. The pressure pieces 72, 73 are formed in the same configuration with a projected portion 74 of smaller diameter, which is projected out of the recess 25 in an engaging relationship with each of the cutout openings 26, 26, and with a cup-shaped stopper portion 75 of larger diameter the bottom of which abuts to each of the transverse walls of the recess 25 under the force of the spring 71 and which is slidably guided by and along the cavity 76. As apparent from FIG. 2, within a cavity 76 of the stopper portion 75 the end of the coiled spring 71 is accommodated in engagement therewith.

Next, the operation of the embodiment will be explained. In FIG. 1, when the manipulator 50 is swung in a clockwise direction, the slider 20 is linearly moved along and within the casing 10 in such a manner that the projected end 21 of the slider 20 linked with the manipulator 50 is pushed into the casing 10 by the latter. Then, the movable contact 60 and the neutral returning means 70 are operated to thereby move from the state of FIG. 5 to the state of FIG. 6. Namely, the sliding piece 61 of the movable contact 60 slides on the common fixed contact 42 in contact therewith and the sliding piece 62 thereof comes into contact with the forward fixed contact 43 so as to bring the first electric circuit to the closed state. At the same time, with respect to the neutral returning means 70, the pressure piece 73 is pushed at the stopper portion 75 thereof by the slider 20 so as to move forwards, while the pressure piece 72 stays immovable thereby allow the relative movement within the recess 25 in the backward direction by the abutment of the projected end 74 thereof against the forwardly positioned transverse wall of the holder 30, so that the coiled spring 71 is compressed between the pressure pieces 72 and 73 to produce the returning force to the initial neutral position of the slider 20. When the manipulator 50 is released, the pressure piece 73 is moved backwards by the force of the compressed coiled spring 71 since the pressure piece 72 remains in abutment to the transverse wall of the holder 30. The slider 20 is moved backwards along with the pressure piece 73 so as to be returned to the neutral position thereof where each of the pressure pieces 72 and 73 is in the abutted condition against the transverse walls of the recess 26, respectively. Then, the manipulator 50 is returned by the resilient force of the spring 53 to its initial neutral position where the click ball 52 is engaged with the concave portion 14 of the slant guide surface 13. When the manipulator is moved counterclockwise to pull the slider 20, the movable contact 60 and the neutral returning means 70 are operated backwardly through the slider 20 to move from the state of FIG. 5 to the state of FIG. 7, whereby the second electric circuit is brought into the closed condition. In FIG. 7, the operation and movement of the movable contact 60 and the neutral returning means 70 are effected in an opposed direction in comparison to FIG. 6. Since the manner of the operation and movement of related parts is substantially similer or identical to FIG. 6, the detailed explanation will be abbreviated.

As explained hereinbefore, as the manipulator 50 is constructed to swingably move in two directions opposite to each other, the slider 20 provided with the movable contact 60 functions as a slider switch of push-pull type which is capable of performing switching operation of two or more electric circuits. Also, with the employment of the see-saw typed manipulator 50, the slider switch 20 may be formed shorter in total length while maintaining the stroke of its movement greater. The position of the pivot of the manipulator 50 may be freely adjusted by changing the length of the support arms 11 or the like, and the length of the link may be adjusted optionally by changing the connected position between the projected end 21 and the slot 54 or others. Hence, the stroke of movement of the movable contact 60 may be easily adjusted and the arrangement of the manipulator 50 may be selectively changed. Since the slider switch 20 moves linearly without accompanying the movement in arcs, the thickness thereof may be effectively diminished. The returning movement of the slider 20 is performed by a single spring 71 thereby resulting in a decrease in number of component parts and the improvement in assembling operation. The spring 71 is adapted to be combined with each of the pressure pieces 72, 73 previous to installation so as possible to facilitate the assembling. Further, the load of an operation of the slider switch 20 may be maintained evenly and adjusted easily by the employment of the single spring 71. Though the neutral returning means 70 is arranged in the parallel offset position to the central longitudinal axis of the slider 20, the provision of the ribs 27 and the rails 28 allows the forward and backward movement of the slider 20 to be effected linearly and smoothly without inclination of the slider 20 so as possible to prevent partial wear. Especially, with combination of the slider 20 of push-pull type and the manipulator 50 of see-saw type, the switch may be compact in its whole arrangement, while being capable of assuredly performing the switching operation of the multiple circuits.

Having described the preferred embodiment of the present invention, it is to be understood that various modifications may be made therein, and it is intended to cover in the appended claims all such modifications as fall within the true spirit and scope of the invention.

What is claimed is:

1. An electric switch comprising:

a substantially hollow casing;

a slider being arranged within said hollow casing to be linearly movable in forward and backward directions along a longitudinal axis of the casing;

slider return means for returning said slider to a neutral position thereof, the slider return means being located in the casing;

a movable contact comprising sliding pieces arranged on said slider;

fixed contacts in said casing which are selectively connected to said movable contact upon each forward and backward movement of said slider; and a rocker manipulator being pivotally mounted on said casing to be swingable in clockwise and counterclockwise directions and a pair of slots formed on extension walls being engageable with a pair of engaging bosses formed on the opposed lateral sides of the projected end of said slider to control the forward and backward movement of the slider, said slider return means being provided on said slider with a spring for biasing the slider to the neutral position after making said movable contact momentarily engage said selected fixed contact by swinging said manipulator.

2. The electric switch according to claim 1, wherein said casing is a substantially rectangular tube provided at an open end thereof with a longitudinally projected support arm and a guide surface having a concave portion thereon, and said manipulator is pivotally mounted on said support arm and has click means to be guided by said surface and to be engaged with the concave portion at its neutral inoperative position.

3. The electric switch according to claim 1, wherein said slider is provided with first and second compartments formed on both sides of a longitudinal axis thereof along the forward and backward direction, said movable contact being arranged in the first compartment and said slider return means being arranged in the second compartment.

4. The electric switch according to claim 3, further comprising:

a holder of upwardly opened rectangular shape being fixedly housed within said casing and having a length for accommodating the forward and backward movement of said slider therein; and a base plate for said fixed contacts being stationarily carried on said holder with hooks formed on both sides of said holder, wherein said slider is in slidable contact with the internal wall of said holder to be guided thereby in the forward and backward direction.

5. The electric switch according to claim 1, wherein said slider return means further comprises said spring being formed of a compressed coiled spring extending in the forward and backward direction and a pair of pressure pieces formed in symmetrical configuration disposed on each of the forward and the backward end of said coiled spring, one of which is pushed by said slider in a direction while another one stays immovable so that said spring is compressed therebetween to produce a force to return the slider to the neutral position.

6. An electric switch comprising:

a substantially hollow tubular casing;

a slider linearly movable from a neutral position in opposite forward and backward directions along a longitudinal axis of said casing;

a holder being immovable arranged in said casing and slidably accommodating therein said slider to guide the forward and backward movement thereof;

slider return means for returning said slider to the neutral position;

a plurality of fixed contacts including a common contact fixedly arranged on a base plate which is provided on said holder, said fixed contacts to be selectively engaged by a movable contact upon forward and backward movement of said slider;

said movable contact comprising two sliding pieces arranged on said slider, one of said sliding pieces of said movable contact sliding on said common contact of said plurality of fixed contacts and another sliding piece thereof contacting with one of the remaining plurality of fixed contacts so as to close the electric circuit; and a manipulator pivotably mounted on an end of said casing to be swingable clockwise and counterclockwise and operatively linked with an end of said slider to push and pull the slider in accordance with the clockwise and counterclockwise motion thereof, said slider return means being provided on said slider with a compressed spring for biassing the slider to the neutral position after making said movable contact engage momentarily with one of said remaining selected fixed contacts by swinging said manipulator.

7. The electric switch according to claim 6, wherein said casing is a substantially rectangular tube provided at end open end thereof with a longitudinally projected support arm and a guide surface having a concave portion thereon, and said manipulator is pivotally mounted on said support arm and has a click means to be guided by said surface and to be engaged with the concave portion at its neutral inoperative position.

8. The electric switch according to claim 6, wherein said slider is provided with first and second compartments formed on both sides of a longitudinal axis thereof along the forward and backward direction.

9. The electric switch according to claim 6 wherein said slider return means comprises a spring being formed as a compressed coiled spring extending in the forward and backward direction and a pair of pressure pieces formed in symmetrical configuration disposed on each of the forward and the backward end of said coiled spring, one of said pressure pieces is pushed by said slider in a direction while the other pressure piece stays immovable so that said spring is compressed therebetween to produce a force to return the slider to the neutral position.

* * * * *